United States Patent [19]

Harbom et al.

[11] Patent Number: 5,044,121

[45] Date of Patent: Sep. 3, 1991

[54] WINDOW AND DOOR STRUCTURE

[75] Inventors: John Harbom, Bolten; Allan Skjodt, Caledon East, both of Canada

[73] Assignee: Plastmo Ltd., Brampton, Canada

[21] Appl. No.: 650,535

[22] Filed: Feb. 5, 1991

[30] Foreign Application Priority Data

Feb. 6, 1990 [CA] Canada ..... 2009435

[51] Int. Cl.[5] ..... E05D 7/00; E06B 7/14

[52] U.S. Cl. ..... 49/401; 49/408; 52/209

[58] Field of Search ..... 49/401, 400, 402, 408, 49/471; 52/209

[56] References Cited

U.S. PATENT DOCUMENTS

| | | | |
|---|---|---|---|
| 3,383,815 | 5/1968 | Smith, Jr. | 49/408 X |
| 3,520,084 | 7/1970 | Gigante | 49/401 X |
| 3,636,660 | 1/1972 | Peterson | 49/471 X |
| 4,040,219 | 8/1977 | Budich | 52/209 |
| 4,614,062 | 9/1986 | Sperr | 49/401 X |
| 4,852,312 | 8/1989 | Harbom | 52/209 X |

*Primary Examiner*—Philip C. Kannan

*Attorney, Agent, or Firm*—Arne I. Fors

[57] ABSTRACT

A window or door unit is disclosed having means for equalizing air pressure within a window or door sash about the perimeter and front portion of the sash with atmospheric air pressure at the exterior of the sash under high wind conditions to avoid drawing up and accumulation of water within the sash. The structure of the invention comprises the provision of at least one vent opening in the upper portion of the sash on the exterior side of the sash for communication of exterior air with the interior of the sash and equalization of air pressure about the perimeter of the interior of the sash, in communication with at least one exterior water drain hole at the bottom of the sash, with exterior atmospheric air pressure.

10 Claims, 3 Drawing Sheets

FIG. 1
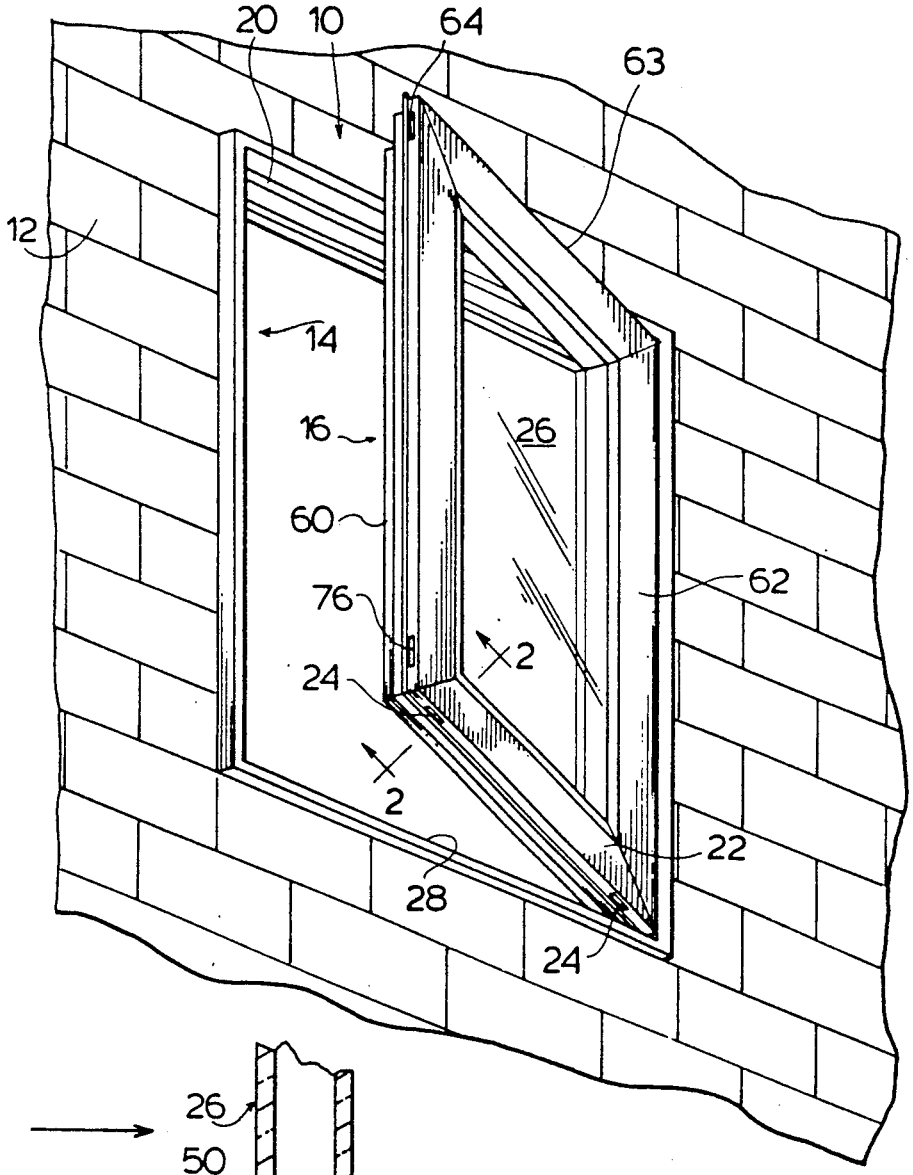
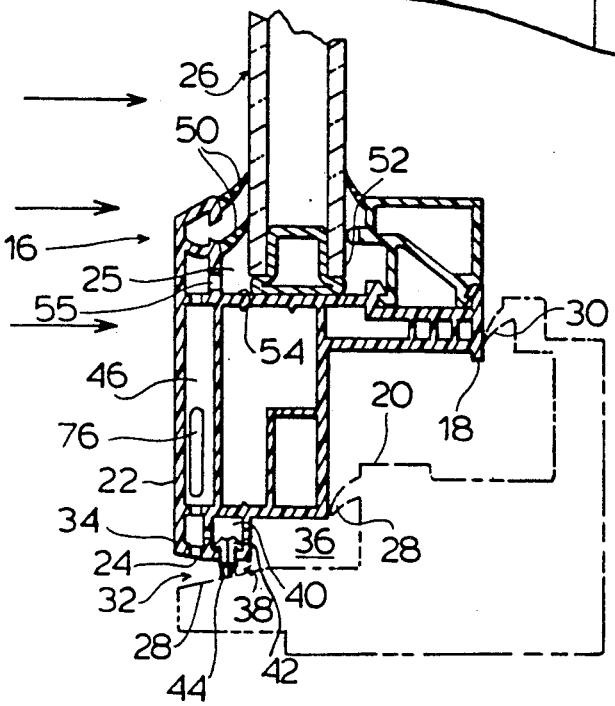
FIG. 2

FIG. 3
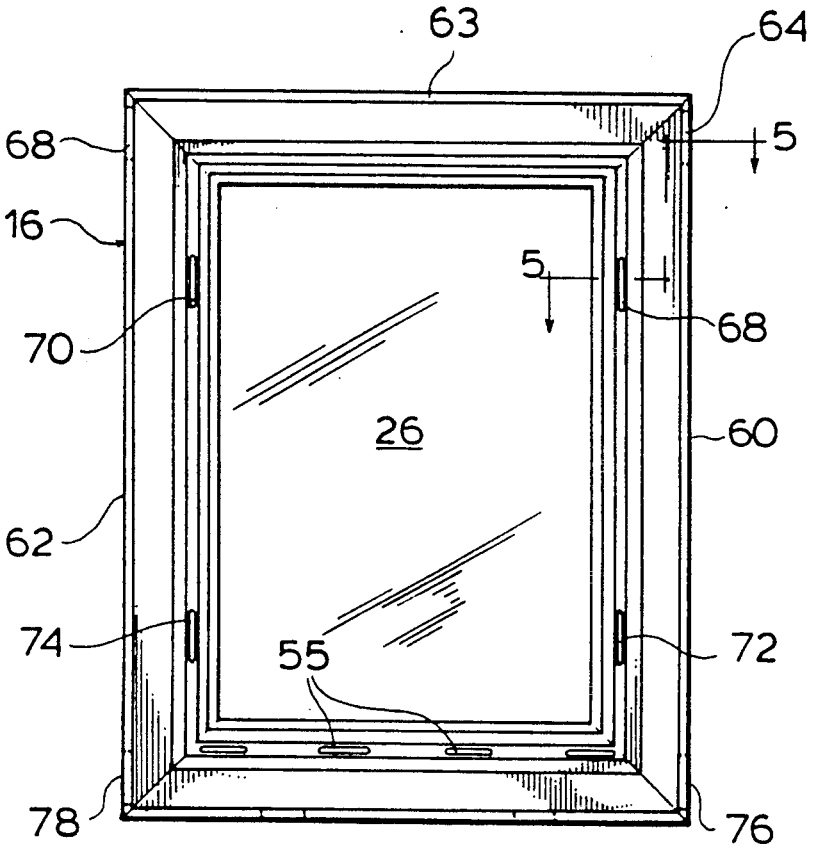
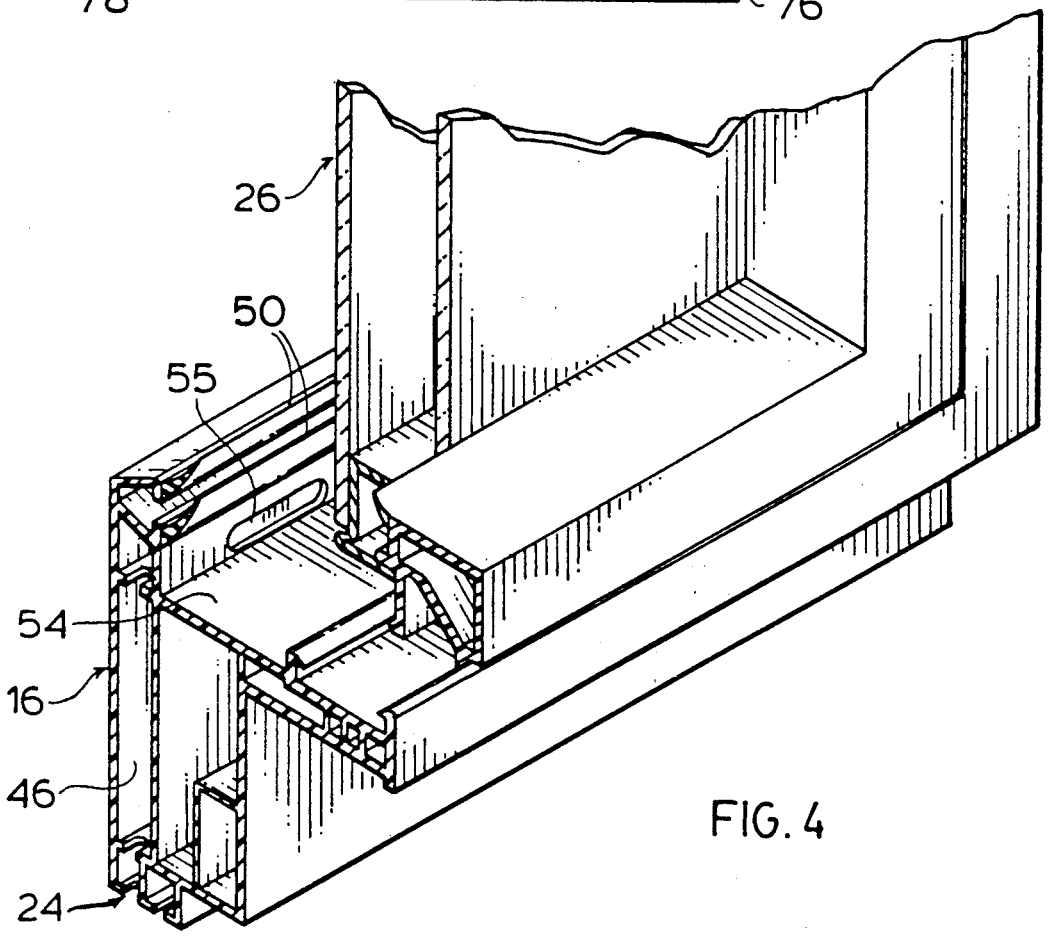
FIG. 4

WINDOW AND DOOR STRUCTURE

FIELD OF INVENTION

This invention relates to a window or door unit and, more particularly, relates to a window or door unit including a sash having vent openings for equalizing the air pressure along an interior gap between the glass pane and its resilient mounting means with exterior air pressure.

BACKGROUND OF THE INVENTION

In window units such as windows of double pane construction, problems frequently arise due to moisture build up in a peripheral gap between the sash and the window panes due to water forced in by wind-driven rain. Drainage holes are conventionally found in the window sill for draining this water externally of the window as it collects. During storms, winds of high velocity cause a zone of high air pressure on and adjacent the walls of buildings, relative to the air pressure within the buildings and relative to the air pressure within the sashes of windows located on said walls, particularly if said windows are snugly mounted. The interiors of the window sashes, such as extruded plastic or metal window sashes, are essentially hollow and contain recesses in which single, double and triple-glazed window panes are mounted by means of continuous resilient flanges. The high exterior air pressure thus in effect generates a partial vacuum within the window sashes which sucks up water as it flows down and across the exterior faces of the windows during storms to accumulate within the window sashes.

Various attempts have been made in the past to overcome such problems. An attempt at overcoming such problems is discussed in U.S. Pat. No. 3,636,660 issued Jan. 25, 1972 to Gerald D. Peterson. The window unit described in this patents includes a weep or drainage chamber in the lower sill with drainage passageways along the sill to permit such entrapped water to flow into the chamber. The window unit also includes air passageways from the weep chamber to the interior of the dwelling to minimize a spouting effect on the collected drainage water that might be caused by sudden wind gusts during a driving rain storm. However, such a structure may suffer from heat loss due to the leakage of air into the dwelling in which it is installed, particularly in cold northern climates.

It is desirable therefore, to provide a means for draining water entrapped between the pane and its resilient sealing means and for reducing the problem of spouting of such entrapped water, while at the same time maintaining an effective air seal with the interior of the room in which it is installed.

It is therefore an object of one aspect of the invention to provide a window or door unit having vent means for equalizing the pressure between the window or door sash sealing gap and the outside atmosphere while maintaining good thermal efficiency.

It is an other object of the invention to provide air pressure equalization throughout the sill, jambs and header in a sash member.

SUMMARY OF THE INVENTION

It has been found surprisingly that equalization of the air pressure within a window or door sash about the perimeter of the sash with atmospheric air pressure at the exterior of the sash substantially obviates sucking or drawing up and accumulation of water within the sash. More particularly, the structure of the invention comprises the provision of at least one vent opening in the upper portion of the sash on the exterior side of the sash for communication of exterior air with the interior of the sash and equalization of air pressure about the perimeter and front portion of the interior of the sash, in communication with at least one exterior water drain hole at the bottom of the sash, with exterior atmospheric air pressure.

The above and other objects of the invention are attained by means of window or door unit comprising: a window or door sash for mounting in a wall opening, said sash having a sill, a header and a pair of substantially parallel side jambs, a glass pane retained within said sash by continuous, resilient mounting means defining a sealing gap between the glass pane and the sill, jambs and header of the sash, said glass pane having an exterior side and an opposite interior side, at least one drain opening in the sill communicating the sealing gap with the atmosphere on the exterior side of the glass pane, and at least one air vent at an upper end of said sash communicating the sealing gap with the atmosphere on the exterior side of the glass pane whereby a substantially uniform air pressure maintained around the perimeter of the pane defined by the said sealing gap is equalized with the exterior air pressure.

BRIEF DESCRIPTION OF THE DRAWINGS

The window or door unit of the invention will now be described in detail with reference to the drawings, in which:

FIG. 1 is a perspective illustration of a window or door unit of the invention mounted in a wall opening;

FIG. 2 is a sectional view of the sash at the sill taken along 2—2 of FIG. 1, showing a frame by ghost lines;

FIG. 3 is an elevational view of the sash showing the rear surface thereof that normally faces the interior of the dwelling;

FIG. 4 is a perspective view, partly cut away, showing the venting means in the sill of the sash member.

DESCRIPTION OF THE PREFERRED EMBODIMENT

Figure 5:
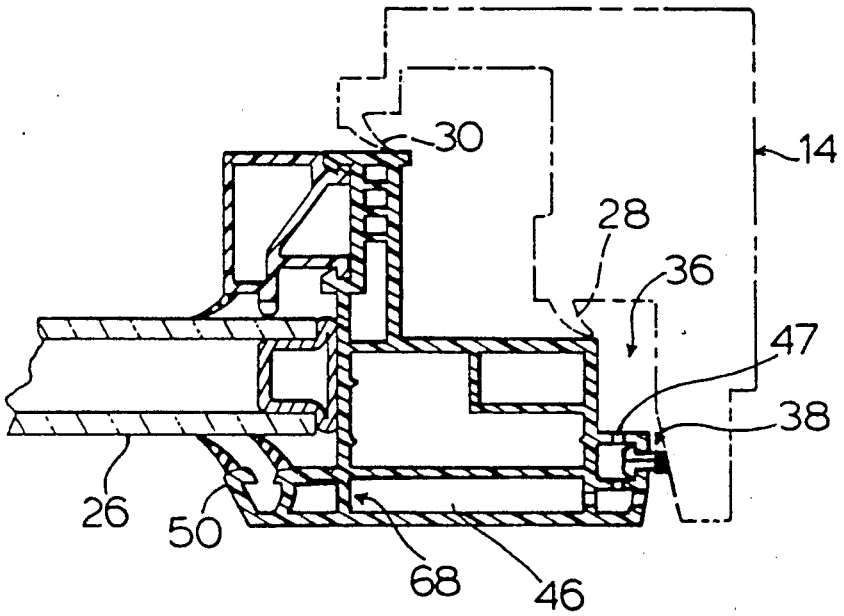
FIG. 5 is a sectional view taken along line 5—5 of FIG. 3 of an upper portion of a window or door jamb.

In FIG. 1, a window unit is shown generally at 10 mounted within a wall 12 of a dwelling. The window unit consists generally of a frame 14 and a sash 16. While sash 16 is shown as pivotably mounted in frame 14 in a casement style, for purposes of illustration, the sash is mated with frame 14 by nesting the stepped contours 18 of the sash into corresponding and matching contours 20 of frame 14, and can be pivotally mounted, slidably mounted or fixedly mounted in frame 14. It will be understood that although the description will proceed with particular reference to window units and window sash, door units such as side hinge doors, sliding patio doors, and the like are contemplated within the scope of the invention.

Sill 22 of sash 16 includes ambient or exterior air openings 24 in the lowermost edge of the sill in proximity to the left and right hand corners thereof for allowing external air access to and drainage of moisture from the sealing gap 25 between double window pane 26 and its resilient sealing means in a manner to be explained below.

When sash member 16 is mounted into its closed position, a snug fit is defined with frame member 14 by means of resilient sealing ribs 28 and 30, as shown in FIGS. 2 and 5. An air passageway permitting the flow of external air to inner chamber 36 of frame 14 is defined between sash 16 and frame 14 about the perimeter of sash 16 by means of elongated rain screen 38 snap-mounted into peripheral edge slot 40. Rain screen 38 has opposed barbs 42 for a friction fit in slot 40 and bristles 44 for allowing air to pass therethrough but to obstruct the passage of water. With reference to FIG. 5, chamber 36 furthermore is shown in communication with external vents by opening 47 to ensure the air pressure in chamber 36 reaches exterior pressure via cavity 46. Exterior air thus is allowed to enter chamber 36 to equalize the air pressure therein with exterior air pressure to substantially preclude the passage of water due to a drawing or sucking up of water through gap 32.

The sash and frame are so designed that a slight gap 32 is maintained between the bottom edge 34 of sill 22 and opposed bottom wall 28 of frame 14. Thus, while the openings 24 offer some degree of protection from outside moisture such as wind-driven rain by virtue of being recessed within the frame, the gap 32 is sufficiently wide to allow moisture to drain from and external air to enter the openings 24. The ambient air openings 24 are in communication with internal passageway 46 which communicates with sealing gap 25 defined by resilient ribs 50, the edge 52 of pane 26 and the opposed internal wall 54 of sash 16 about the periphery of pane 26 through elongated internal sill openings 55.

It can be seen, particularly in FIGS. 2–5, that internal passageway 46 extends up the jambs 60, 62 and across header 63. Passageway 46 is communicated with exterior air at its upper end through exterior vent openings 64, 66 formed at opposite upper side edges of the sash in jambs 60, 62 and is communicated with sealing gap 25 by upper inner openings 68, 70 and lower inner openings 72, 74. Opening 68 show in FIG. 5 is typical thereof.

Exterior side vent openings 76, 78 preferably are also provided near the bottom of the opposite side edges of the jambs 60, 62 to allow ingress of exterior air into passageway 46 and to allow egress of any water within the said jambs. It will be understood that exterior vents may also be formed in the upper edge of header 63 in addition to or as an alternative to upper vents 64, 66, it being important that sufficient vent openings be provided about the perimeter of the sash to allow for a uniform pressure equalized with outside air pressure.

The present invention provides a number of important advantages. Air pressure within hollow extruded sashes at the perimeter and adjacent the outside face thereof is uniformly equalized with outside air pressure to effectively avoid a relatively low internal pressure (partial vacuum), thereby obviating drawing or sucking up of water into the sashes which typically occurs during high wind and rain conditions. The forming and placement of drain holes and vents can be easily accomplished without sacrificing thermal efficiency of the window units.

It has been found that window or door sashes according to the present invention have substantially improved resistance to the penetration and accumulation of water therein under simulated high wind conditions. The American Architectural Manufacturers Association in its publication entitled "Voluntary Specifications for Polyvinyl Chloride Prime Windows and Sliding Glass Doors" calls for windows or doors to be water-tight at 635 pascals test pressure in 120 mph wind zones at an elevation of 500 feet above ground level. Windows according to the present invention with the subject pressure equalization embodied therein were tested successfully at 1400 pascals test pressure. The same window without pressure equalization according to the present invention could pass such water test at only 200 pascals pressure.

It will be understood that minor modifications are contemplated without departing from the scope of the invention as described in the specification with particular reference to the drawings or as recited in the accompanying claims.

We claim:

1. In a window or door unit including a sash, said sash having a sill, a header and a pair of side jambs, a glass pane retained within said sash by continuous and resilient mounting means defining with the pane a sealing gap about the perimeter of the said pane, said glass pane having an exterior side and an interior side, at least one drain hole in the sill communicating the sealing gap with the atmosphere on the exterior side of the glass pane, at least one vent opening in the sash on the exterior side of the sash above the sill for communication of exterior air with the interior of the sash and for equalization of air pressure about the perimeter and front portion of the interior of the sash with exterior air pressure.

2. A sash as claimed in claim 1, wherein said sash has at least one said vent opening formed in the upper portion of each sash jamb on the side thereof.

3. A sash as claimed in claim 2, wherein said sash has at least one said vent opening formed in the upper portion of each sash jamb on the side thereof.

4. A sash as claimed in claim 1 wherein said sash has at least one said vent opening formed in the upper portion of each sash jamb on the side thereof, and additionally comprising a said vent opening formed in the lower portion of each said sash jamb on the side thereof.

5. A sash as claimed in claim 4, wherein said sash has sufficient vent openings spaced thereabout to provide a uniform air pressure within the sash about its perimeter equalized with the exterior air pressure.

6. A window or door unit as claimed in claim 1 additionally comprising a frame in which the window or door sash is mounted, said frame and window or door sash defining at least one inner chamber between the frame and window or door sash, and an air passageway defined between the window or door sash and frame on the exterior side of the sash for permitting the flow of external air to the inner chamber for equalizing air pressure within said chamber with the exterior air pressure.

7. A window or door unit as claimed in claim 6, in which at least one vent opening is formed in the sash jambs for communication of air within the said chamber with the interior of the sash for equalization of air pressure within said chamber with the air pressure within the sash and with the exterior air pressure.

8. A window or door sash for mounting in a wall opening, said sash having a sill, a header and a pair of substantially parallel side jambs, a glass pane retained within said sash by continuous, resilient mounting means defining a sealing gap between the glass pane and the sill, jambs and header of the sash, said glass pane having an exterior side and an opposite interior side, at least one drain opening in the sill communicating the sealing gap with the atmosphere on the exterior side of the glass pane, and at least one air vent at an upper end of said sash communicating the sealing gap with atmosphere on the exterior side of the glass pane whereby a substantially uniform air pressure maintained around the perimeter of the pane defined by the said sealing gap is equalized with the exterior air pressure.

9. A sash as claimed in claim 8 wherein said sash has at least one said vent opening formed in the upper portion of each sash jamb on the side thereof, and additionally comprising a said vent opening formed in the lower portion of each said sash jamb on the side thereof.

10. A sash as claimed in claim 9, wherein said sash has at least one said vent opening formed in the header.

* * * * *